US010140941B2

(12) United States Patent
Wang et al.

(10) Patent No.: US 10,140,941 B2
(45) Date of Patent: Nov. 27, 2018

(54) METHOD AND APPARATUS FOR ADJUSTING A SCREEN REFRESH FREQUENCY AND DISPLAY

(71) Applicants: BOE TECHNOLOGY GROUP CO., LTD., Beijing (CN); BEIJING BOE DISPLAY TECHNOLOGY CO., LTD., Beijing (CN)

(72) Inventors: Mingchao Wang, Beijing (CN); Chunbing Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/521,228

(22) PCT Filed: Aug. 12, 2016

(86) PCT No.: PCT/CN2016/094853
§ 371 (c)(1),
(2) Date: Apr. 21, 2017

(87) PCT Pub. No.: WO2017/118023
PCT Pub. Date: Jul. 13, 2017

(65) Prior Publication Data

US 2018/0108311 A1 Apr. 19, 2018

(30) Foreign Application Priority Data

Jan. 5, 2016 (CN) ..... 2016 1 0004902

(51) Int. Cl.
*G09G 3/36* (2006.01)
*G09G 3/20* (2006.01)

(52) U.S. Cl.
CPC ..... *G09G 3/3648* (2013.01); *G09G 3/20* (2013.01); *G09G 3/36* (2013.01); *G09G 2310/08* (2013.01);
(Continued)

(58) Field of Classification Search
CPC ..... G06F 11/00; G06F 13/372; G06F 1/32; G09G 3/34; G09G 3/36; G09G 3/3696; G09G 5/00; G09G 5/18; H04N 13/04
See application file for complete search history.

(56) References Cited

U.S. PATENT DOCUMENTS

2015/0264342 A1* 9/2015 Chen ..... G09G 3/3611 348/51
2016/0118012 A1* 4/2016 Chang ..... G09G 3/2022 345/212

FOREIGN PATENT DOCUMENTS

CN 102592555 A 7/2012
CN 103854624 A 6/2014
(Continued)

OTHER PUBLICATIONS

Chinese Search Report, for Chinese Patent Application No. 201610004902.1, dated May 16, 2016, 10 pages.
(Continued)

*Primary Examiner* — Chanh Nguyen
*Assistant Examiner* — Nguyen H Truong
(74) *Attorney, Agent, or Firm* — Kinney & Lange, P.A.

(57) ABSTRACT

The present disclosure provides a method and apparatus for adjusting a screen refresh frequency and a display. The method comprises: acquiring and storing a current frame of picture signal; calculating a similarity value between the current frame of picture signal and a previous frame of picture signal; and acquiring a screen refresh frequency for the current frame of picture signal based on the similarity
(Continued)

value according to a preset relationship between similarity values and screen refresh frequencies, so as to realize adjustment of the screen refresh frequency.

13 Claims, 5 Drawing Sheets

(52) U.S. Cl.
CPC ..... *G09G 2330/021* (2013.01); *G09G 2340/0435* (2013.01)

(56) References Cited

FOREIGN PATENT DOCUMENTS

| | | | |
|---|---|---|---|
| CN | 104269155 | A | 1/2015 |
| CN | 105448225 | A | 3/2016 |
| JP | 2004151222 | A | 5/2004 |

OTHER PUBLICATIONS

International Search Report and Written Opinion from PCT Application Serial No. PCT/CN2016/094853, dated Oct. 28, 2016, 15 pages.
First CN Office Action from Chinese Patent Application No. 201610009021, dated Jul. 28, 2016, 11 pages.
Second CN Office Action from Chinese Patent Application No. 201610009021, dated Dec. 29, 2016, 10 pages.
Chinese Rejection Decision, for Chinese Patent Application No. 201610004902.1, dated Apr. 10, 2017, 11 pages.

* cited by examiner

METHOD AND APPARATUS FOR ADJUSTING A SCREEN REFRESH FREQUENCY AND DISPLAY

CROSS-REFERENCE TO RELATED APPLICATION(S)

This application claims a priority to the Chinese Patent Application No. 201610004902.1, filed on Jan. 5, 2016, which is incorporated herein by reference.

TECHNICAL FIELD

Embodiments of the present disclosure relate to the field of screen display, and more particularly, to a method and apparatus for adjusting a screen refresh frequency and a display.

BACKGROUND

Contradiction between high-quality pictures and low power consumption is a problem to be solved in the field of display. In the conventional technology, interlaced scanning is implemented within a frame of picture, and for pixels which are not needed to be charged, n frames of pictures are charged at one time, so as to achieve the purpose of energy conservation. The primary means is to connect an "AND gate" at a gate terminal, and control a state of the "AND gate" through a pulse, so as to achieve control of switching states for various rows, and thus achieve the purpose of interlaced scanning. At present, due to development of products in the display industry towards a Gate Driver On Array (GOA) direction, there is need to manufacture an "AND gate" on an array during manufacturing of a GOA. As a result, the process becomes complicated, which is not beneficial to improvements of production and yield of the products.

SUMMARY

The embodiments of the present disclosure provides a method and apparatus for adjusting a screen refresh frequency and a display.

An aspect of the embodiments of the present disclosure provides a method for adjusting a screen refresh frequency, comprising:

acquiring and storing a current frame of picture signal;

calculating a similarity value between the current frame of picture signal and a previous frame of picture signal; and acquiring a screen refresh frequency for the current frame of picture based on the similarity value according to a preset relationship between similarity values and screen refresh frequencies, so as to realize adjustment of the screen refresh frequency.

In an example, calculating the similarity value comprises:

implementing a bitwise exclusive OR operation on the current frame of picture signal and the previous frame of picture signal, and calculating a ratio of a number of 0 s to a total number of 0 s and 1 s in a result of the exclusive OR operation as the similarity value between the current frame of picture signal and the previous frame of picture signal.

In an example, the preset relationship between similarity values and screen refresh frequencies is acquired by the following equation:

$$f=-a*S+b,$$

wherein f is a screen refresh frequency, S is a similarity value, a is a maximum screen refresh frequency minus a minimum screen refresh frequency, and b is the maximum screen refresh frequency.

In an example, the maximum screen refresh frequency is set as a minimum frequency for persistence of vision by human eyes.

In an example, the minimum screen refresh frequency is set as 30 Hz.

Another aspect of the embodiments of the present disclosure provides an apparatus for adjusting a screen refresh frequency, comprising:

a signal acquisition unit configured to acquire a current frame of picture signal;

a storage unit configured to store the current frame of picture signal and a previous frame of picture signal; and a control unit configured to calculate a similarity value between the current frame of picture signal and the previous frame of picture signal, and acquire a screen refresh frequency for the current frame of picture signal based on the similarity value according to a preset relationship between similarity values and screen refresh frequencies, so as to realize adjustment of the screen refresh frequency.

In an example, the control unit is configured to:

implement a bitwise exclusive OR operation on the current frame of picture signal and the previous frame of picture signal, and calculate a ratio of a number of 0 s to a total number of 0 s and 1 s in a result of the exclusive OR operation as the similarity value between the current frame of picture signal and the previous frame of picture signal.

In an example, the preset relationship between similarity values and screen refresh frequencies is acquired by the following equation:

$$f=-a*S+b,$$

wherein f is a screen refresh frequency, S is a similarity value, a is a maximum screen refresh frequency minus a minimum screen refresh frequency, and b is the maximum screen refresh frequency.

In an example, the maximum screen refresh frequency is set as a minimum frequency for persistence of vision by human eyes.

In an example, the minimum screen refresh frequency is set as 30 Hz.

A further aspect of the embodiments of the present disclosure provides a display, comprising the apparatus for adjusting a screen refresh frequency described above.

In an example, the display further comprises: a timing control unit, a source driving circuit, a gate driving circuit and a display panel, wherein the apparatus for adjusting a screen refresh frequency outputs a screen refresh frequency for the current frame of picture to the timing control unit, to control a charging time for pixels of the display panel through the source driving circuit and the gate driving circuit.

BRIEF DESCRIPTION OF THE DRAWINGS

The above and other aspects, features and advantages of the various embodiments of the present disclosure will become more apparent from the following detailed description taken in conjunction with the accompanying drawings in which.

It is to be understood that the same or similar reference numerals in the accompanying drawings indicate like or similar elements, features and structures.

DETAILED DESCRIPTION

The exemplary embodiment of the present disclosure will be described in detail below with reference to the accompanying drawings. In the following description, some specific embodiments are for illustrative purposes only and are not to be construed as limiting the disclosure, but are merely examples of the present disclosure. Conventional structures or constructions will be omitted when they may cause confusion with the understanding of the present disclosure.

Figure 1:
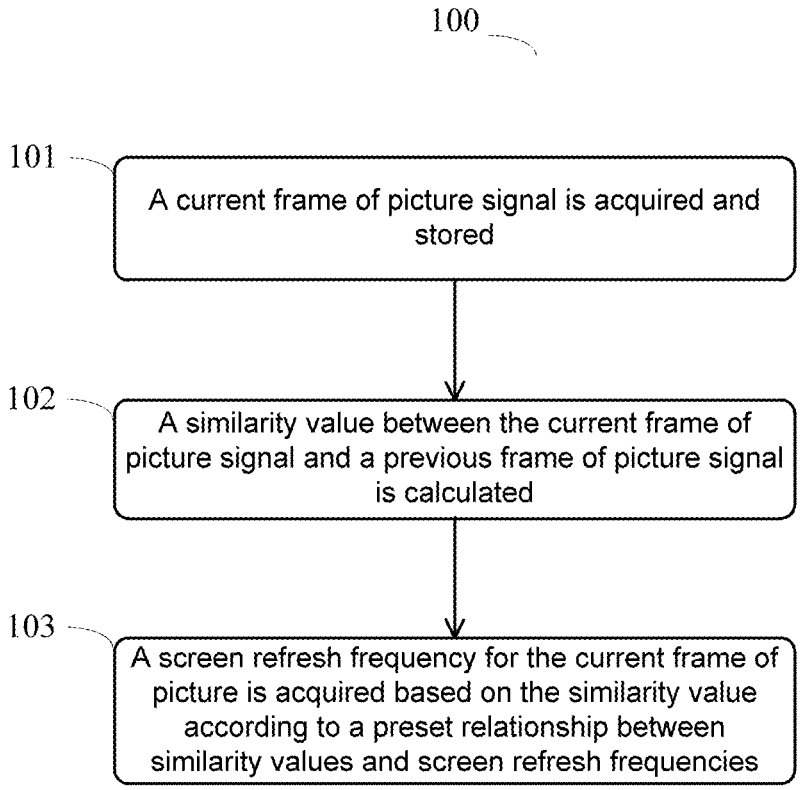
FIG. 1 is a flowchart illustrating a method for adjusting a screen refresh frequency according to an embodiment of the present disclosure.

With reference to FIG. 1, there is illustrated a flowchart of a method 100 for adjusting a screen refresh frequency according to an embodiment of the present disclosure.

In step 101, a current frame of picture signal is acquired and stored.

In step 102, a similarity value between the current frame of picture signal and a previous frame of picture signal is calculated.

In step 103, a screen refresh frequency for the current frame of picture is acquired based on the similarity value according to a preset relationship between similarity values and screen refresh frequencies, so as to realize adjustment of the screen refresh frequency.

Figure 2:
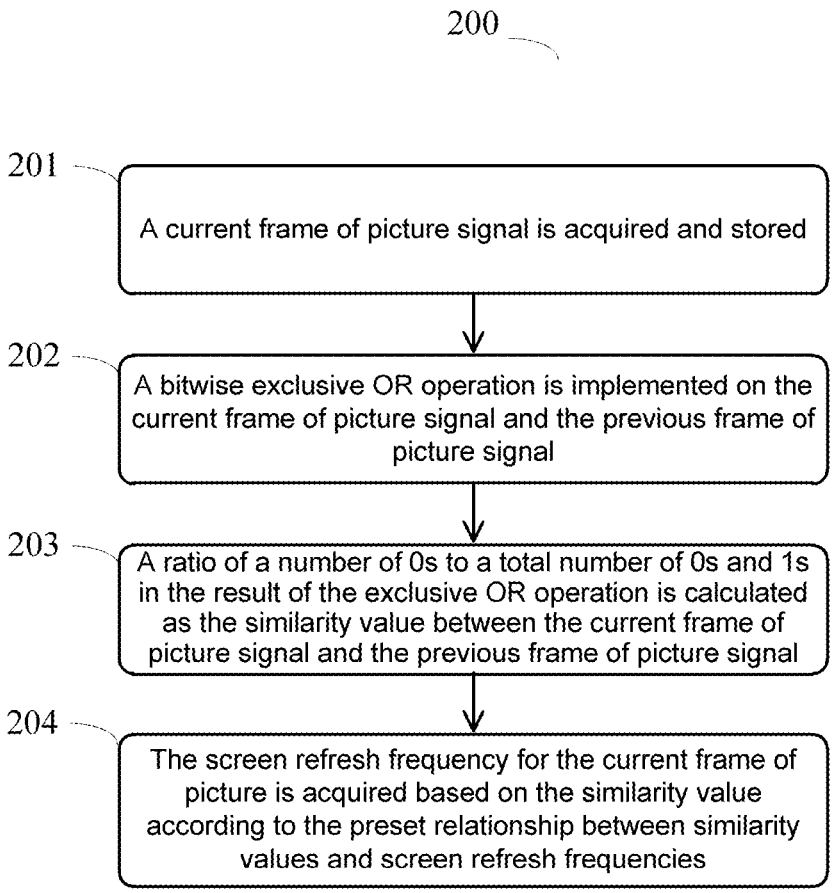
FIG. 2 is a flowchart illustrating a method for adjusting a screen refresh frequency according to another embodiment of the present disclosure.
Figure 3:
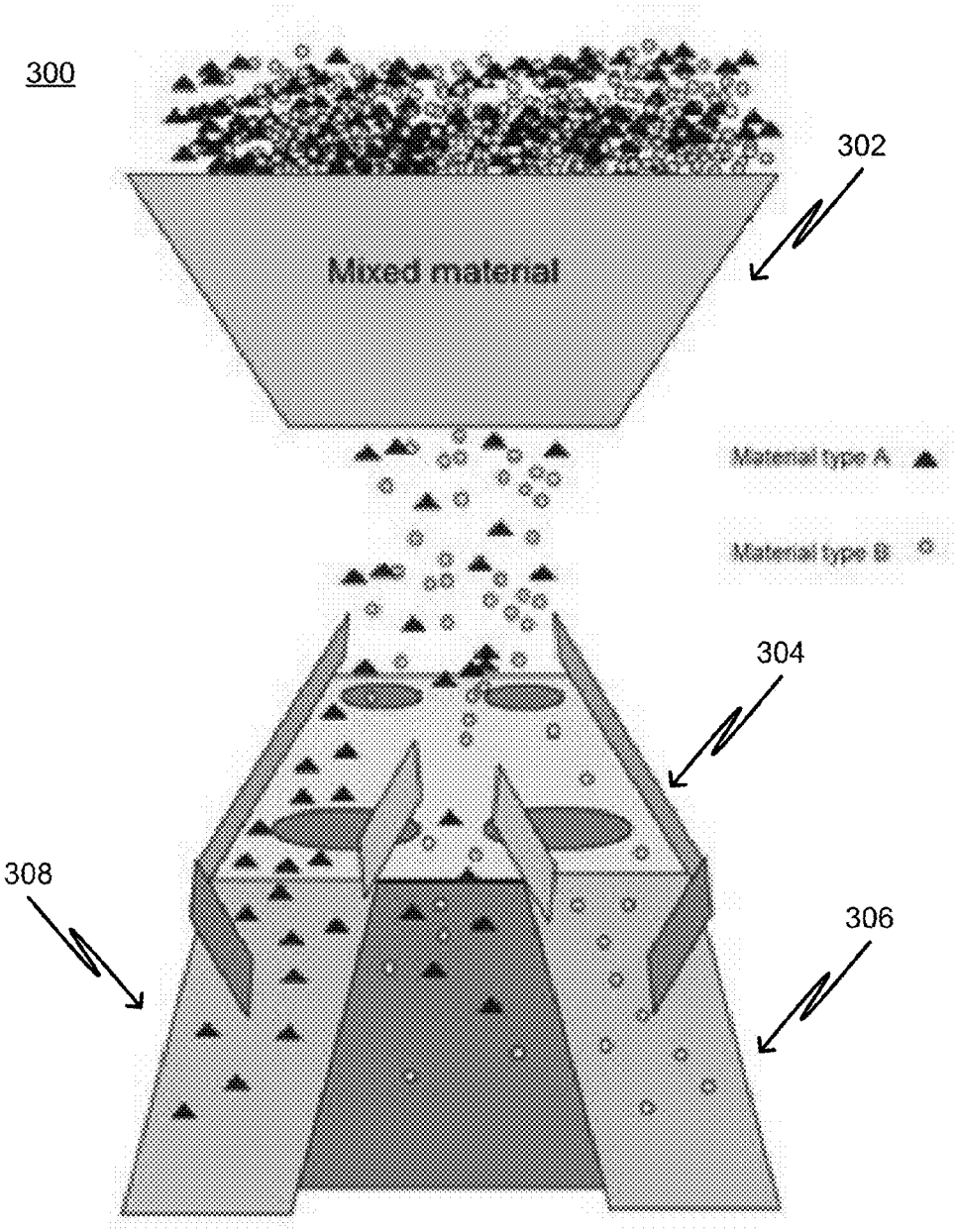
FIG. 3 is a diagram illustrating a relationship between similarities between two adjacent frames of pictures and screen refresh frequencies according to an embodiment of the present disclosure.

The method for adjusting a screen refresh frequency according to an embodiment of the present disclosure will be described in detail below with reference to FIGS. 2 and 3. FIG. 2 is a flow diagram illustrating a method 200 for adjusting a screen refresh frequency according to another embodiment of the present disclosure; and FIG. 3 is a diagram illustrating a relationship between similarities between two adjacent frames of pictures and screen refresh frequencies according to an embodiment of the present disclosure.

As shown in FIG. 2, in step 201, a current frame of picture signal is acquired and stored. For example, the current frame of picture signal may be acquired frame by frame during display, or the current frame of picture signal may be acquired periodically at a constant time interval or may be acquired aperiodically. The present disclosure is not limited thereto. The acquired current frame of picture signal is stored in a storage unit. A previous frame of picture signal may also be pre-stored in the storage unit, or may be pre-stored in another storage unit. It should be noted that the term "adjacent two frames of pictures" in the present application indicates that the two frames of pictures may be immediately adjacent to each other, or may be intersected with a plurality of frames (for example, one frame, two frames, or three frames), as long as the similarity between the two frames of pictures can be used to reflect a rate of change of the displayed screen. It will be understood by those skilled in the art that the previous frame of picture signal may be a frame of picture signal immediately before the current frame of picture signal or a frame of picture signal with a specific number of frames (e.g., two frames or three frames) from the current frame, which may be set by those skilled in the art according to the practical situations.

In step 202, a bitwise exclusive OR operation is implemented on the current frame of picture signal and the previous frame of picture signal. Here a frame of picture signal may be represented by a series of binary numbers. By way of example, in a result of the bitwise exclusive OR operation, 0 represents identity, and 1 represents difference.

In step 203, a ratio of a number of 0 s to a total number of 0 s and 1 s in the result of the exclusive OR operation is calculated as the similarity value between the current frame of picture signal and the previous frame of picture signal. For example, assuming that in the result of the exclusive OR operation, the number of 0 s is A, and the total number of 0 s and 1 s is B, the similarity value S=A/B. In this case, the greater the similarity value, the higher the similarity between the current frame of picture and the previous frame of picture. The smaller the similarity value, the lower the similarity between the current frame of picture and the previous frame of picture.

In step 204, the screen refresh frequency for the current frame of picture is acquired based on the similarity value according to the preset relationship between similarity values and screen refresh frequencies. The preset relationship between similarity values and screen refresh frequencies may be acquired by the following equation:

$$f=-a*S+b,$$

wherein f is a screen refresh frequency, S is a similarity value, a is a maximum screen refresh frequency minus a minimum screen refresh frequency, and b is the maximum screen refresh frequency.

It should be noted that the current frame of picture signal may be used as a "previous frame of picture signal" in the next operation after the following operations are completed.

A size of the screen refresh frequency is determined by a similarity between two adjacent frames of pictures. For example, the refresh frequency for the current frame of picture is determined by the similarity between the current frame of picture and the previous frame of picture. As shown in FIG. 3, the greater the similarity, the smaller the screen refresh frequency f; and on the contrary, the smaller the similarity, the greater the screen refresh frequency f. Thus, if the similarity between the current frame of picture and the previous frame of picture is high, the screen refresh frequency f may be adjusted to a smaller value, so that the power consumption of the electronic device can be reduced. By acquiring the similarity between the two adjacent frames of pictures, it is possible to realize adjustment of the screen refresh frequency, so as to solve the problem that the screen refresh frequency of the display product is not adjustable which results in high power consumption of the electronic device.

In the present embodiment, the maximum screen refresh frequency is set to, for example, a minimum frequency for persistence of vision of human eyes, and the minimum screen refresh frequency is set to, for example, 30 Hz. The control unit 404 may acquire the screen refresh frequency for the current frame of picture based on the similarity value according to the above-described relationship.

In practical operations, a value of the screen refresh frequency is between the maximum screen refresh frequency and the minimum screen refresh frequency, and also depends on the similarity value S between adjacent frames of pictures. In the present embodiment, the similarity value S is between 0 and 1. As an example, assuming that the maximum screen refresh frequency is 60 Hz and the minimum screen refresh frequency is 30 Hz, a variation range of the screen refresh frequency is 30 Hz to 60 Hz, that is, a=60 Hz−30 Hz=30 Hz. In practical operations, if two frames of pictures are exactly the same, S is 1, and then f=−30 Hz*1+60 Hz=30 Hz. In this case, the minimum screen refresh frequency is used. If the similarity value between the two frames of pictures is 0.8, f=−30 Hz*0.8+60 Hz=36 Hz. In this case, the screen refresh frequency is 36 Hz. If the two frame of pictures are completely different, S=0, and then f=−30 Hz*0+60 Hz=60 Hz. In this case, the maximum screen refresh frequency is used.

Similarly, it is also possible to calculate a ratio of a number A of 1 s to a total number B of 0 s and 1 s in the result of the exclusive OR operation as the similarity value S. In this case, the larger the similarity value S, the lower the similarity between the current frame of picture and the previous frame of picture. At the same time, the preset relationship between similarity values and screen refresh frequencies is adjusted accordingly, to realize control of the screen refresh frequency.

The method 200 for adjusting a screen refresh frequency according to the present embodiment acquires the similarity between the two adjacent frames of pictures and adjusts the screen refresh frequency according to the preset relationship between similarities between two adjacent frames of pictures and screen refresh frequencies, thereby solving the problem that the screen refresh frequency of the display product is not adjustable which results in high power consumption of the electronic device.

Figure 4:
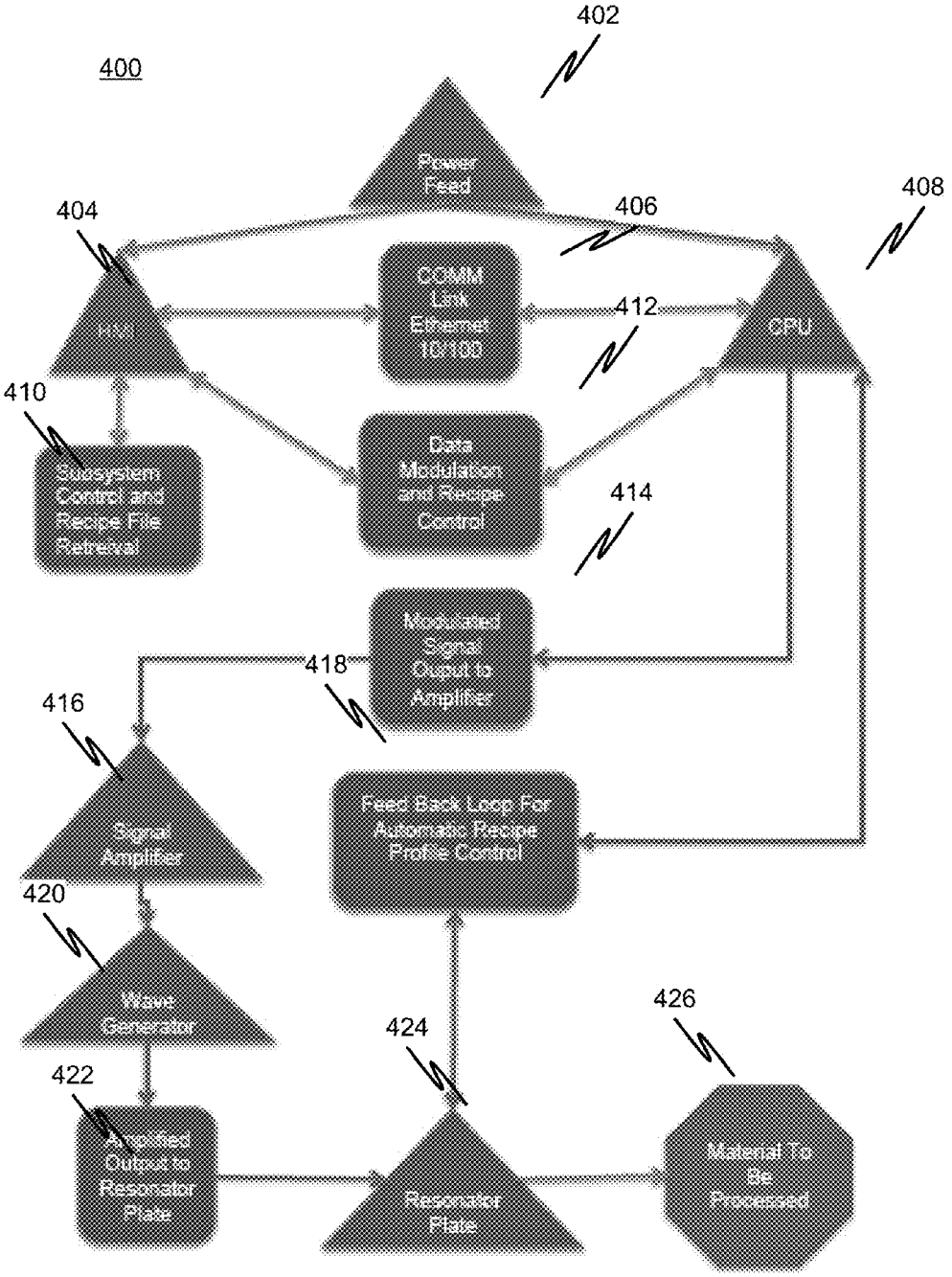
FIG. 4 is a block diagram illustrating an apparatus for adjusting a screen refresh frequency according to an embodiment of the present disclosure.

FIG. 4 is a block diagram illustrating an apparatus 400 for adjusting a screen refresh frequency according to an embodiment of the present disclosure. The apparatus 400 comprises a signal acquisition unit 401, a storage unit 402, a control unit 404, and an amplification unit 405.

The signal acquisition unit 401 is configured to acquire a current frame of picture signal.

The storage unit 402 is configured to store the acquired current frame of picture signal and a previous frame of picture signal. The storage unit 402 may comprise a first storage unit 402A and a second storage unit 402B. It will be understood by those skilled in the art that the current frame of picture signal and the previous frame of picture signal may be stored in the first storage unit 402A and the second storage unit 402B, respectively. Alternatively, both of the current frame of picture signal and the previous frame of picture signal may be stored in the first storage unit 402A or the second storage unit 402B, which is not limited in the present disclosure.

The control unit 404 is configured to calculate a similarity value between the current frame of picture signal and the previous frame of picture signal, and acquire a screen refresh frequency for the current frame of picture based on the similarity value according to a preset relationship between similarity values and screen refresh frequencies.

For example, the current frame of picture signal may be acquired frame by frame during display, or the current frame of picture signal may be acquired periodically at a constant time interval or may be acquired aperiodically. The present disclosure is not limited thereto.

In the present embodiment, the control unit 404 firstly implements a bitwise exclusive OR operation on the current frame of picture signal and the previous frame of picture signal. Here a frame of picture signal is represented by a series of binary numbers. By way of example, in a result of the bitwise exclusive OR operation, 0 represents identity, and 1 represents difference. Then, the control unit 404 calculates a ratio of a number of 0 s to a total number of 0 s and 1 s in the result of the exclusive OR operation as the similarity value between the current frame of picture signal and the previous frame of picture signal. For example, assuming that in the result of the exclusive OR operation, the number of 0 s is A, and the total number of 0 s and 1 s is B, the similarity value S=A/B. In this case, the greater the similarity value, the higher the similarity between the current frame of picture and the previous frame of picture. The smaller the similarity value, the lower the similarity between the current frame of picture and the previous frame of picture.

The relationship between similarity values and screen refresh frequencies is preset by the following equation:

$$f=-a*S+b,$$

wherein f is a screen refresh frequency, S is a similarity value, a is a maximum screen refresh frequency minus a minimum screen refresh frequency, and b is the maximum screen refresh frequency.

A size of the screen refresh frequency is determined by a similarity between two adjacent frames of pictures. For example, the refresh frequency for the current frame of picture is determined by the similarity between the current frame of picture and the previous frame of picture. As shown in FIG. 3, the greater the similarity, the smaller the screen refresh frequency f; and on the contrary, the smaller the similarity, the greater the screen refresh frequency f. Thus, if the similarity between the current frame of picture and the previous frame of picture is high, the screen refresh frequency f may be adjusted to a smaller value, so that the power consumption of the electronic device can be reduced. By acquiring the similarity between the two adjacent frames of pictures, it is possible to realize adjustment of the screen refresh frequency, so as to solve the problem that the screen refresh frequency of the display product is not adjustable which results in high power consumption of the electronic device.

In the present embodiment, the maximum screen refresh frequency is set to, for example, a minimum frequency for persistence of vision of human eyes, and the minimum screen refresh frequency is set to, for example, 30 Hz. The control unit 404 acquires a screen refresh frequency for the current frame of picture (i.e., the adjusted screen refresh frequency) based on the similarity value according to the above-described relationship.

Similarly, the control unit 404 may also calculate a ratio of a number A of 1 s to a total number B of 0 s and 1 s in the result of the exclusive OR operation as the similarity value S. In this case, the larger the similarity value S, the lower the similarity between the current frame of picture and the previous frame of picture. At the same time, the preset relationship between similarity values and screen refresh frequencies is adjusted accordingly, to realize control of the screen refresh frequency.

Alternatively, the amplification unit 405 amplifies the screen refresh frequency for the current frame of picture which is acquired by the control unit 404 and outputs it to control a refresh frequency output by a Timing Controller (TCON).

Figure 5:
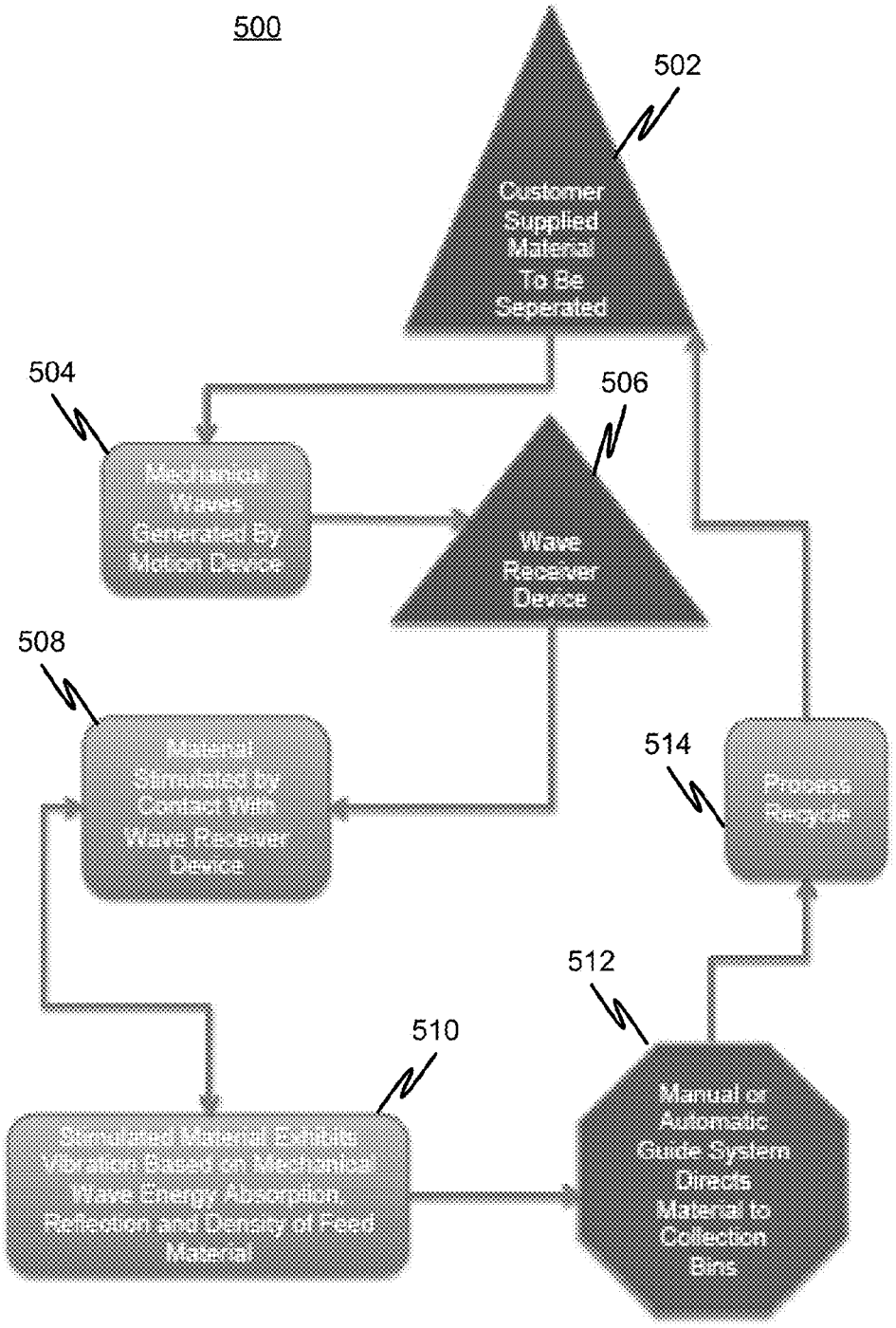
FIG. 5 is a block diagram illustrating a display according to an embodiment of the present disclosure.

FIG. 5 is a block diagram illustrating a display 500 according to an embodiment of the present disclosure. The display 500 comprises the apparatus 1 for adjusting a screen refresh frequency, a TCON 2, a source driving circuit 3, a display panel 4, and a gate driving circuit 5.

The apparatus 1 for adjusting a screen refresh frequency may receive a frame of picture signal and then output a screen refresh frequency to convert a frequency of a synchronization signal output by the TCON 2, so that the TCON 2 outputs a suitable frequency for the current frame of picture (the screen refresh frequency for the current frame of picture signal). The suitable frequency is used to control a charging time for pixels of the display panel 4 through the source driving circuit 3 and the gate driving circuit 5, thereby reducing the power consumption of the display device while achieving high picture quality.

It should be noted that the scope of the subject content to be protected by the present disclosure is not limited to the specific embodiments described herein. For example, some embodiments may be in a form of hardware, so that the present disclosure is implemented on for example a device or a combination of devices, while other embodiments may be in a form of software and/or firmware. Similarly, although the scope of the subject content to be protected is not limited in this aspect, some embodiments may comprise one or more materials, for example, a storage medium or storage media. The storage medium may be for example a CD-ROM, a computer disc, a flash memory or the like, which may have instructions stored thereon. The instructions when executed by a system such as a computer system, a computing platform, another system or the like, may enable a processor to implement one of the embodiments described above according to the subject content to be protected. In a possible implementation, the computing platform may comprise one or more processing units or processors, one or more input/output devices (for example, a display, a keyboard and/or a mouse), and one or more memories (for example, a static random access memory, a dynamic random access memory, a flash memory, and/or a hardware driver).

Further, it should be noted that the technical solutions of the present disclosure are merely described by way of example in the above description, and it does not mean that the present disclosure is limited to the above steps and structures. The steps and structures may be adjusted and selected as needed if possible. Therefore, some steps and units are not elements necessary for implementing the general inventive idea of the present disclosure. Consequently, the technical features necessary for the present disclosure are merely limited by the minimum requirements for implementing the general inventive idea of the present disclosure instead of the above specific examples.

Obviously, various changes and modifications can be made by those skilled in the art without departing from the spirit and scope of the present disclosure. The scope of the present disclosure is defined by the appended claims and equivalents thereof.

We claim:

1. A method for adjusting screen refresh frequency, comprising:

acquiring and storing a current frame of picture signal;

calculating a similarity value between the current frame of picture signal and a previous frame of picture signal; and acquiring a screen refresh frequency for the current frame of picture signal based on the similarity value according to a preset relationship between similarity values and screen refresh frequencies, so as to realize adjustment of the screen refresh frequency;

wherein the preset relationship between similarity values and screen refresh frequencies is acquired by a following equation $$f=-a*S+b,$$

wherein f is the screen refresh frequency, S is the similarity value, a is a maximum screen refresh frequency minus a minimum screen refresh frequency, and b is the maximum screen refresh frequency.

2. The method according to claim 1, wherein calculating the similarity value comprises:

implementing a bitwise exclusive OR operation on the current frame of picture signal and the previous frame of picture signal, and calculating a ratio of a number of 0s to a total number of 0s and 1s in a result of the exclusive OR operation as the similarity value between the current frame of picture signal and the previous frame of picture signal.

3. The method according to claim 1, wherein the maximum screen refresh frequency is set as a minimum frequency for persistence of vision by human eyes.

4. The method according to claim 1, wherein the minimum screen refresh frequency is set as 30 Hz.

5. An apparatus for adjusting screen refresh frequency, comprising hardware, and/or a computer system comprising one or more processors and one or more memories having instructions stored thereon for controlling operation of the one or more processors, configured to:

acquire a current frame of picture signal;

store the current frame of picture signal and a previous frame of picture signal; and calculate a similarity value between the current frame of picture signal and the previous frame of picture signal, and acquire a screen refresh frequency for the current frame of picture signal based on the similarity value according to a preset relationship between similarity values and screen refresh frequencies, so as to realize adjustment of the screen refresh frequency;

wherein the preset relationship between similarity values and screen refresh frequencies is acquired by a following equation:

$$f=-a*S+b,$$

wherein f is the screen refresh frequency, S is the similarity value, a is a maximum screen refresh frequency minus a minimum screen refresh frequency, and b is the maximum screen refresh frequency.

6. The apparatus according to claim 5, wherein the hardware and/or computer system is further configured to:

implement a bitwise exclusive OR operation on the current frame of picture signal and the previous frame of picture signal, and calculate a ratio of a number of 0s to a total number of 0s and 1s in a result of the exclusive OR operation as the similarity value between the current frame of picture signal and the previous frame of picture signal.

7. A display, comprising the apparatus for adjusting screen refresh frequency according to claim 6.

8. The apparatus according to claim 5, wherein the maximum screen refresh frequency is set as a minimum frequency for persistence of vision by human eyes.

9. A display, comprising the apparatus for adjusting screen refresh frequency according to claim 8.

10. The apparatus according to claim 5, wherein the minimum screen refresh frequency is set as 30 Hz.

11. A display, comprising the apparatus for adjusting screen refresh frequency according to claim 10.

12. A display, comprising the apparatus for adjusting screen refresh frequency according to claim 5.

13. The display according to claim 12, further comprising: a timing control unit, a source driving circuit, a gate driving circuit and a display panel, wherein the apparatus for adjusting screen refresh frequency outputs the screen refresh frequency for the current frame of picture to the timing control unit, to control a charging time for pixels of the display panel through the source driving circuit and the gate driving circuit.

* * * * *